US009747858B2

(12) United States Patent
Wu

(10) Patent No.: US 9,747,858 B2
(45) Date of Patent: Aug. 29, 2017

(54) SOURCE DRIVER AND SOURCE DRIVE METHOD OF LIQUID CRYSTAL PANEL OF UNEQUAL ROW DRIVE WIDTH

(71) Applicant: Shenzhen China Star Optoelectronics Technology Co., Ltd., Shenzhen (CN)

(72) Inventor: Chihhao Wu, Shenzhen (CN)

(73) Assignee: SHENZHEN CHINA STAR OPTOELECTRONICS TECHNOLOGY CO., LTD., Shenzhen, Guangdong (CN)

( * ) Notice: Subject to any disclaimer, the term of this patent is extended or adjusted under 35 U.S.C. 154(b) by 216 days.

(21) Appl. No.: 14/764,577

(22) PCT Filed: Apr. 3, 2015

(86) PCT No.: PCT/CN2015/075850
§ 371 (c)(1),
(2) Date: Jul. 30, 2015

(87) PCT Pub. No.: WO2016/149961
PCT Pub. Date: Sep. 29, 2016

(65) Prior Publication Data

US 2016/0307534 A1 Oct. 20, 2016

(30) Foreign Application Priority Data

Mar. 20, 2015 (CN) ..... 2015 1 0128095

(51) Int. Cl.
*G09G 3/36* (2006.01)

(52) U.S. Cl.
CPC ... *G09G 3/3688* (2013.01); *G09G 2310/0297* (2013.01); *G09G 2310/06* (2013.01); *G09G 2310/08* (2013.01)

(58) Field of Classification Search
CPC ..... G09G 2310/0297; G09G 2310/06; G09G 2310/08; G09G 3/3688
See application file for complete search history.

(56) References Cited

U.S. PATENT DOCUMENTS 9,311,855 B2 * 4/2016 Jung ..... G06F 1/163
9,312,284 B2 * 4/2016 Wu ..... H01L 27/124
(Continued)

FOREIGN PATENT DOCUMENTS

CN 1381030 A 11/2002
CN 104299587 A 1/2005

*Primary Examiner* — Kenneth Bukowski
(74) *Attorney, Agent, or Firm* — Leong C. Lei

(57) ABSTRACT

The present invention provides a source driver and a source drive method of a liquid crystal panel of unequal row drive width. By providing the input signal decoding control unit electrically coupled to the plurality of data signal output channels and encoding the data signal output channel start address signal and the data signal output channel end address signal in the transport packages of the data signal to be transported to the input signal decoding control unit, the input signal decoding control unit controls the amount of activated data signal output channels to adjust the row drive width for each scan according to the received data signal output channel start address signal and the received data signal output channel end address signal. The row drive width of scan for each row can be dynamically adjusted to transport the data signal to the pixels required to display in each row. It is applicable for non rectangular display for reducing the output power of the liquid crystal panel and the source driver of the liquid crystal panel of unequal row drive width is derived from the present drive structure design. The structure is simple.

12 Claims, 8 Drawing Sheets

(56) References Cited

U.S. PATENT DOCUMENTS

2002/0158855 A1* 10/2002 Matsueda ..... G02F 1/13454
345/204
2008/0018583 A1* 1/2008 Knapp ..... G02F 1/1333
345/99
2008/0174538 A1* 7/2008 Yasuda ..... G09G 3/3648
345/98
2008/0266210 A1* 10/2008 Nonaka ..... G09G 3/20
345/55
2009/0102758 A1* 4/2009 Anzai ..... G09G 3/3225
345/76
2009/0102824 A1* 4/2009 Tanaka ..... G02F 1/134309
345/205
2009/0174640 A1* 7/2009 Nose ..... G09G 3/3629
345/88
2010/0141570 A1* 6/2010 Horiuchi ..... G09G 3/3611
345/100
2012/0001835 A1* 1/2012 Yamamoto ..... G02F 1/13454
345/55
2014/0253419 A1* 9/2014 Tanada ..... G09G 3/2092
345/55
2015/0355487 A1* 12/2015 Emmert ..... G02F 1/13306
349/33
2016/0118004 A1* 4/2016 Xu ..... G09G 3/3648
345/212
2016/0351098 A1* 12/2016 Lin ..... G09G 3/20

* cited by examiner

SOURCE DRIVER AND SOURCE DRIVE METHOD OF LIQUID CRYSTAL PANEL OF UNEQUAL ROW DRIVE WIDTH

FIELD OF THE INVENTION

The present invention relates to a display technology field, and more particularly to a source driver and a source drive method of a liquid crystal panel of unequal row drive width.

BACKGROUND OF THE INVENTION

With the development of display technology, the flat panel device, such as Liquid Crystal Display (LCD) possesses advantages of high image quality, power saving, thin body and wide application scope. Thus, it has been widely applied in various consumer electrical products, such as mobile phone, television, personal digital assistant, digital camera, notebook, laptop, and becomes the major display device.

The Active Matrix Liquid Crystal Display (AMLCD) is the most common display device at present. The Active Matrix Liquid Crystal Display comprises a plurality scan lines extending along the horizontal direction and a plurality of data lines extending along the vertical direction, and the plurality of scan lines and the plurality of data lines criss-cross to form a plurality of pixel areas. Each pixel area comprises one pixel, and each pixel comprises a Thin Film Transistor (TFT). The scan lines are electrically coupled to a scan driver to be employed for transmitting scan signals. The data lines are electrically coupled to a source driver to be employed for transmitting data signals. When a sufficient positive voltage is applied to some scan line in the horizontal direction, all the TFT coupled to the scan line will be activated. Then, the pixel electrodes on this scan line will be coupled to the data lines in the vertical direction to write the data signal loaded in the data line into the pixels and thus to show images.

FIG. 1 is a structural diagram of a source driver according to prior art. As shown in FIG. 1, the source driver 2 comprises a first, a second shift registers 211, 212, a first, a second main latch circuits 221, 222, a first, a second sub latch circuits 231, 232, a first, a second voltage potential conversion circuits 241, 242, a first, a second digital to analog converters 251, 252, a first, a second output buffer circuits 261, 262 and a first, a second output circuits 271, 272.The first shift register 211, the first main latch circuit 221, the first sub latch circuit 231, the first voltage potential conversion circuit 241, the first digital to analog converter 251, the first output buffer circuit 261 and the first output circuit 271 construct a signal channel 281. The source drive signals generated by the signal channel 281 are transmitted to the corresponding pixels via the data lines to make the pixel illuminate. The row drive width of the aforesaid source driver according to prior art are equal for each scan and the dynamical adjustment cannot be possible. It is merely applicable for the traditional rectangular displays.

However, as the constant development of the display technology, the demands of non rectangular displays from the users become more and more. Because the appearance of the display is irregular, the pixel amount proceeding display in one row are different. What FIG. 2 depicts is a pixel arrangement diagram of an irregular liquid crystal display panel. The irregular display panel comprises 15 pixels from pixel (1, 1) to pixel (3, 5) in total. The display pixels in the active area are three pixels from pixel (1, 2) to pixel (1, 4) in the first row, five pixels from pixel (2, 1) to pixel (2, 5) in the second row, three pixels from pixel (3, 2) to pixel (3, 4) in the third row. The rest pixels are all non display pixels. The transmission of the data signal to the non display pixels causes waste of power. Therefore, it is a requirement to the source driver to adjust the row drive width according to the required amount of the display pixels for saving the power consumption.

SUMMARY OF THE INVENTION

An objective of the present invention is to provide a source driver of a liquid crystal panel of unequal row drive width, capable of dynamically adjusting the row drive width of scan for each row to transport the data signal to the pixels required to display in each row and not to transport the data signal to the pixels which are not required to display in each row. It is applicable for non rectangular display and capable of reducing the output power of the liquid crystal panel.

Another objective of the present invention is to provide a source drive method of a liquid crystal panel of unequal row drive width, capable of dynamically adjusting the row drive width of scan for each row to transport the data signal to the pixels required to display in each row and not to transport the data signal to the pixels which are not required to display in each row. It is applicable for non rectangular display and capable of reducing the output power of the liquid crystal panel.

For realizing the aforesaid objectives, the present invention first provides a source driver of a liquid crystal panel of unequal row drive width, comprising an input signal decoding control unit and a plurality of data signal output channels electrically coupled to the input signal decoding control unit;

the input signal decoding control unit receives a data signal output channel start address signal, a data signal output channel end address signal and a data signal input sequence control signal;

the input signal decoding control unit outputs a data signal output sequence control signal;

the input signal decoding control unit controls an amount of activated data signal output channels to adjust a row drive width for each scan according to the received data signal output channel start address signal and the received data signal output channel end address signal.

The input signal decoding control unit comprises a combination switch, and the combination switch comprises a first thin film transistor, a second thin film transistor and a third reverse thin film transistor;

a gate of the first thin film transistor is electrically coupled to the data signal output channel start address signal, and a source is electrically coupled to the data signal input sequence control signal, and a drain is electrically coupled to a register of the data signal output channel corresponding to a start address and a source of the third reverse thin film transistor;

a gate of the second thin film transistor is electrically coupled to the data signal output channel end address signal, and a source is electrically coupled to the data signal output sequence control signal, and a drain is electrically coupled to a register of the data signal output channel corresponding to an end address and a drain of the third reverse thin film transistor;

a gate of the third reverse thin film transistor is electrically coupled to the data signal output channel start address signal, and the source is electrically coupled to the drain of the first thin film transistor, and the drain is electrically coupled to the drain of a second thin film transistor.

The data signal output channel start address signal and the data signal output channel end address signal are encoded in transport packages of data signal and transported with the data signal together.

A length setting mode is added by amending decoding topology of a mini-LVDS transport protocol, and the length setting mode is employed for transporting the data signal output channel start address signal and the data signal output channel end address signal.

A 3-to-8 line decoder is employed to decode the data signal output channel start address signal and the data signal output channel end address signal which are encoded in the transport packages of the data signal.

The data signal output channels comprise: a shift register and a main latch circuit electrically coupled to the input signal decoding control unit, a sub latch circuit, a voltage potential conversion circuit electrically coupled to the sub latch circuit, a digital to analog converter electrically coupled to the voltage potential conversion circuit, an output buffer circuit electrically coupled to the digital to analog converter and an output circuit electrically coupled to the output buffer circuit.

The present invention further provides a source driver of a liquid crystal panel of unequal row drive width, comprising an input signal decoding control unit and a plurality of data signal output channels electrically coupled to the input signal decoding control unit;

the input signal decoding control unit receives a data signal output channel start address signal, a data signal output channel end address signal and a data signal input sequence control signal;

the input signal decoding control unit outputs a data signal output sequence control signal;

the input signal decoding control unit controls an amount of activated data signal output channels to adjust a row drive width for each scan according to the received data signal output channel start address signal and the received data signal output channel end address signal;

wherein the input signal decoding control unit comprises a combination switch, and the combination switch comprises a first thin film transistor, a second thin film transistor and a third reverse thin film transistor;

a gate of the first thin film transistor is electrically coupled to the data signal output channel start address signal, and a source is electrically coupled to the data signal input sequence control signal, and a drain is electrically coupled to a register of the data signal output channel corresponding to a start address and a source of the third reverse thin film transistor;

a gate of the second thin film transistor is electrically coupled to the data signal output channel end address signal, and a source is electrically coupled to the data signal output sequence control signal, and a drain is electrically coupled to a register of the data signal output channel corresponding to an end address and a drain of the third reverse thin film transistor;

a gate of the third reverse thin film transistor is electrically coupled to the data signal output channel start address signal, and the source is electrically coupled to the drain of the first thin film transistor, and the drain is electrically coupled to the drain of a second thin film transistor;

wherein the data signal output channels comprise: a shift register and a main latch circuit electrically coupled to the input signal decoding control unit, a sub latch circuit, a voltage potential conversion circuit electrically coupled to the sub latch circuit, a digital to analog converter electrically coupled to the voltage potential conversion circuit, an output buffer circuit electrically coupled to the digital to analog converter and an output circuit electrically coupled to the output buffer circuit.

The present invention further provides a source drive method of a liquid crystal panel of unequal row drive width, comprising steps of:

step 1, providing a source driver of the liquid crystal panel of unequal row drive width;

the source driver of a liquid crystal panel of unequal row drive width, comprising an input signal decoding control unit and a plurality of data signal output channels electrically coupled to the input signal decoding control unit;

step 2, inputting a data signal output channel start address signal, a data signal output channel end address signal and a data signal input sequence control signal to the input signal decoding control unit;

step 3, decoding the received data signal output channel start address signal and the received data signal output channel end address signal and setting a data signal output channel start address and a data signal output channel end address by the input signal decoding control unit;

step 4, inputting the data signal corresponding to the data signal channels between the data signal output channel start address and the data signal output channel end address, and transporting the data signal to the corresponding pixels.

The input signal decoding control unit comprises a combination switch, and the combination switch comprises a first thin film transistor, a second thin film transistor and a third reverse thin film transistor;

a gate of the first thin film transistor is electrically coupled to the data signal output channel start address signal, and a source is electrically coupled to the data signal input sequence control signal, and a drain is electrically coupled to a register of the data signal output channel corresponding to a start address and a source of the third reverse thin film transistor;

a gate of the second thin film transistor is electrically coupled to the data signal output channel end address signal, and a source is electrically coupled to the data signal output sequence control signal, and a drain is electrically coupled to a register of the data signal output channel corresponding to an end address and a drain of the third reverse thin film transistor;

a gate of the third reverse thin film transistor is electrically coupled to the data signal output channel start address signal, and the source is electrically coupled to the drain of the first thin film transistor, and the drain is electrically coupled to the drain of a second thin film transistor.

In the step 2, the data signal output channel start address signal and the data signal output channel end address signal are encoded in transport packages of data signal and transported with the data signal together.

In the step 2, a length setting mode is added by amending decoding topology of a mini-LVDS transport protocol, and the length setting mode is employed for transporting the data signal output channel start address signal and the data signal output channel end address signal.

The benefits of the present invention are: the present invention provides a source drive method of a liquid crystal panel of unequal row drive width. By providing the input signal decoding control unit electrically coupled to the plurality of data signal output channels and encoding the data signal output channel start address signal and the data signal output channel end address signal in the transport packages of the data signal to be transported to the input signal decoding control unit, the input signal decoding control unit controls the amount of activated data signal output channels to adjust the row drive width for each scan according to the received data signal output channel start address signal and the received data signal output channel end address signal. The row drive width of scan for each row can be dynamically adjusted to transport the data signal to the pixels required to display in each row and not to transport the data signal to the pixels which are not required to display in each row. It is applicable for non rectangular display for reducing the output power of the liquid crystal panel and the source driver of the liquid crystal panel of unequal row drive width is derived from the present drive structure design. The structure is simple.

In order to better understand the characteristics and technical aspect of the invention, please refer to the following detailed description of the present invention is concerned with the diagrams, however, provide reference to the accompanying drawings and description only and is not intended to be limiting of the invention.

BRIEF DESCRIPTION OF THE DRAWINGS

The technical solution and the beneficial effects of the present invention are best understood from the following detailed description with reference to the accompanying figures and embodiments.

In drawings.

DETAILED DESCRIPTION OF PREFERRED EMBODIMENTS

For better explaining the technical solution and the effect of the present invention, the present invention will be further described in detail with the accompanying drawings and the specific embodiments.

Figure 1:
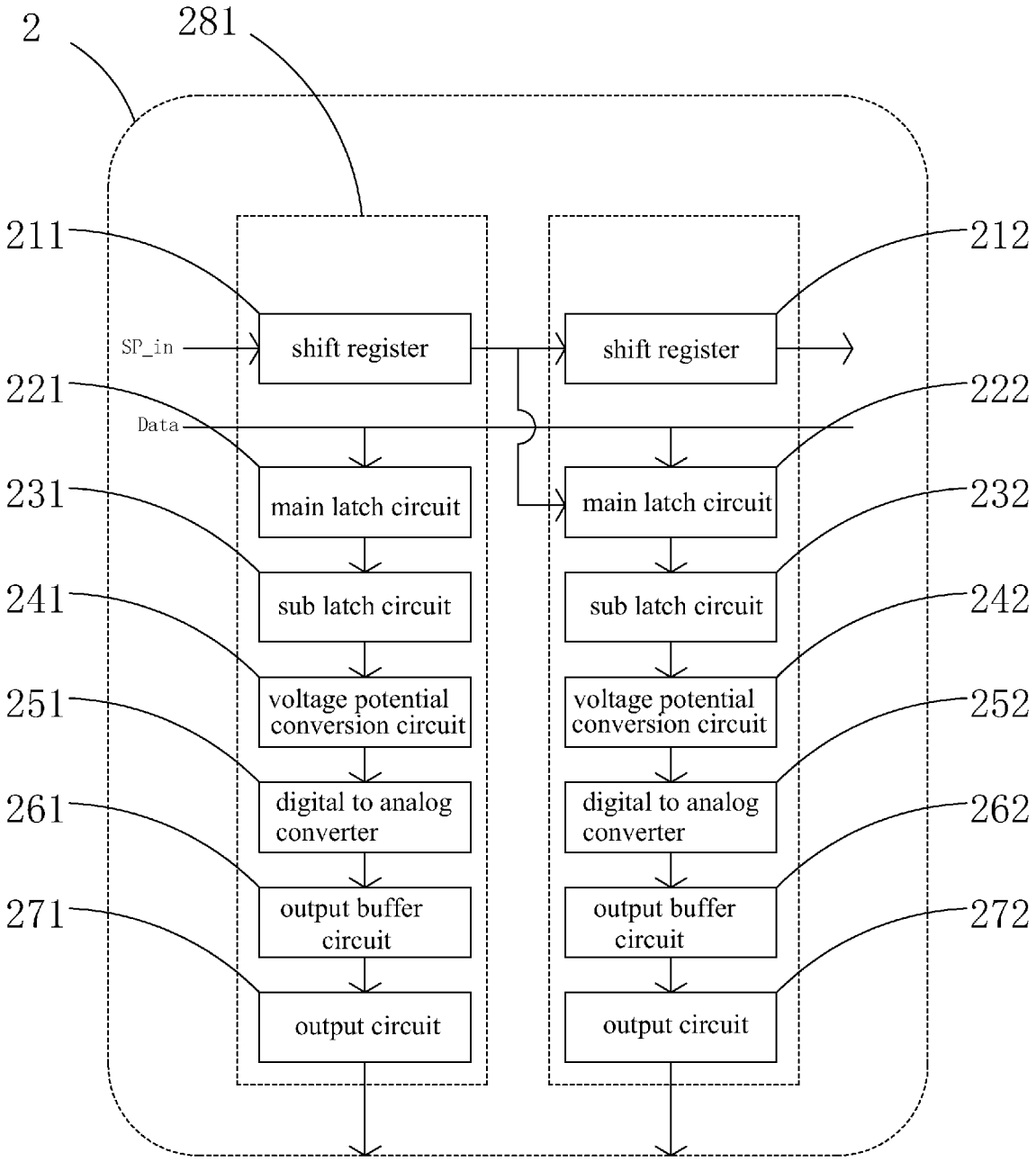
FIG. 1 is a structural diagram of a source driver according to prior art.
Figure 2:
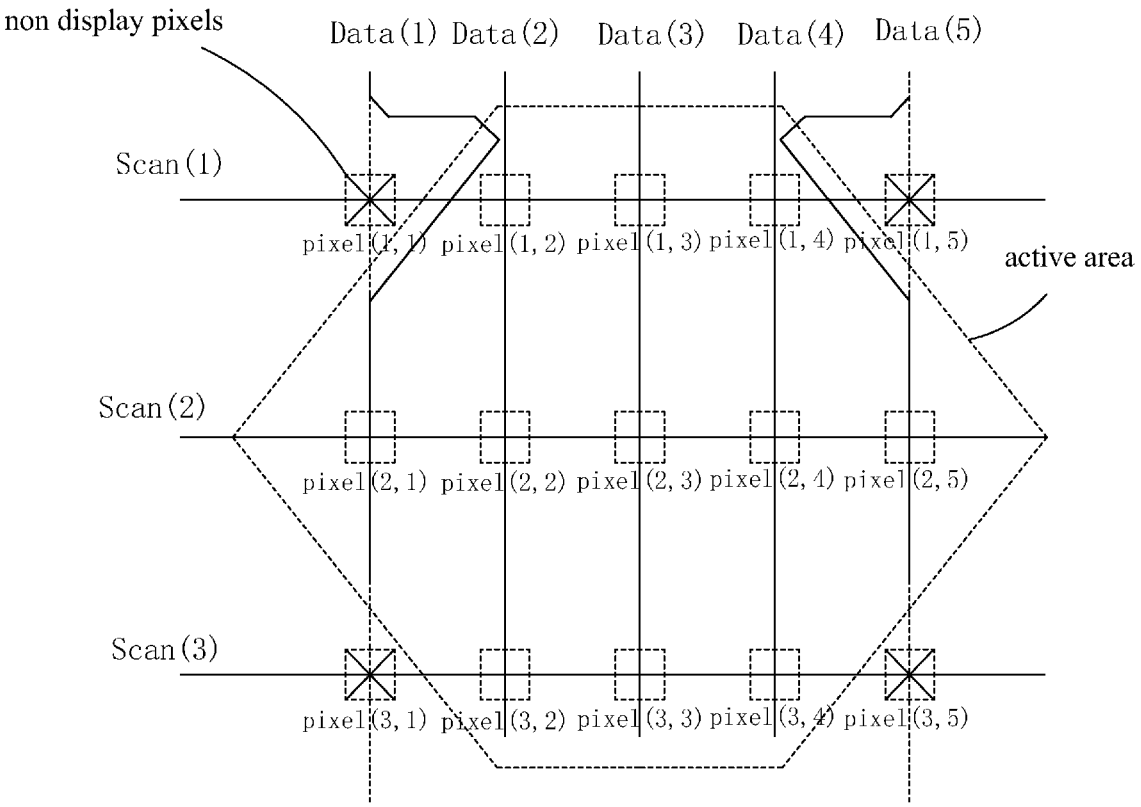
FIG. 2 is a pixel arrangement diagram of an irregular liquid crystal panel.
Figure 3:
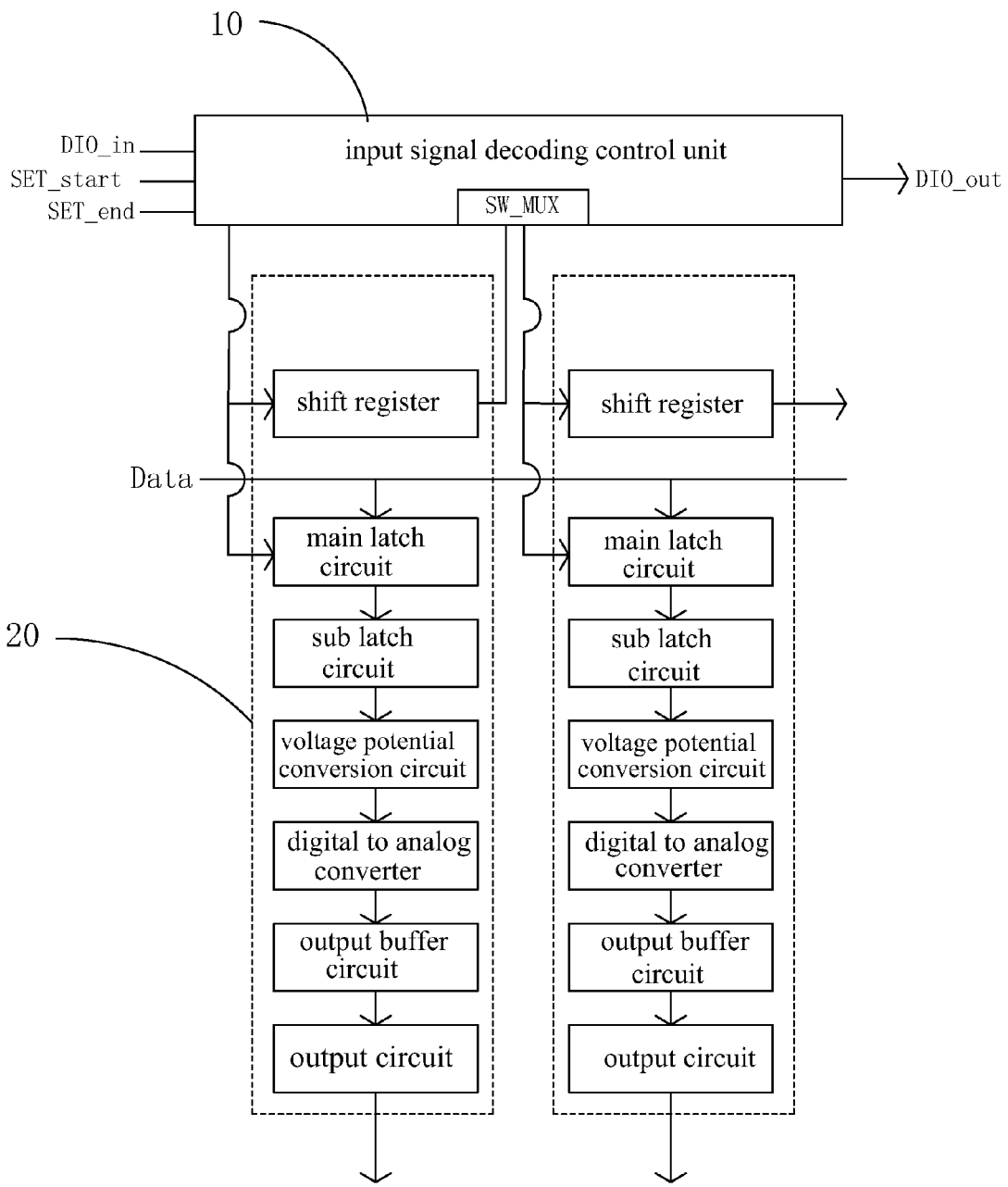
FIG. 3 is a structural diagram of a source driver of a liquid crystal panel of unequal row drive width according to the present invention.

Please refer to FIG. 3. The present invention first provides a source driver of a liquid crystal panel of unequal row drive width, comprising an input signal decoding control unit 10 and a plurality of data signal output channels 20 electrically coupled to the input signal decoding control unit 10.

The input signal decoding control unit 10 receives a data signal output channel start address signal SET_start, a data signal output channel end address signal SET_end and a data signal input sequence control signal DIO_in; the input signal decoding control unit 10 outputs a data signal output sequence control signal DIO_out; the input signal decoding control unit 10 controls an amount of activated data signal output channels 20 to adjust a row drive width for each scan according to the received data signal output channel start address signal SET_start and the received data signal output channel end address signal SET_end.

Specifically, the data signal output channels 20 comprise: a shift register and a main latch circuit electrically coupled to the input signal decoding control unit 10, a sub latch circuit, a voltage potential conversion circuit electrically coupled to the sub latch circuit, a digital to analog converter electrically coupled to the voltage potential conversion circuit, an output buffer circuit electrically coupled to the digital to analog converter and an output circuit electrically coupled to the output buffer circuit.

Figure 4:
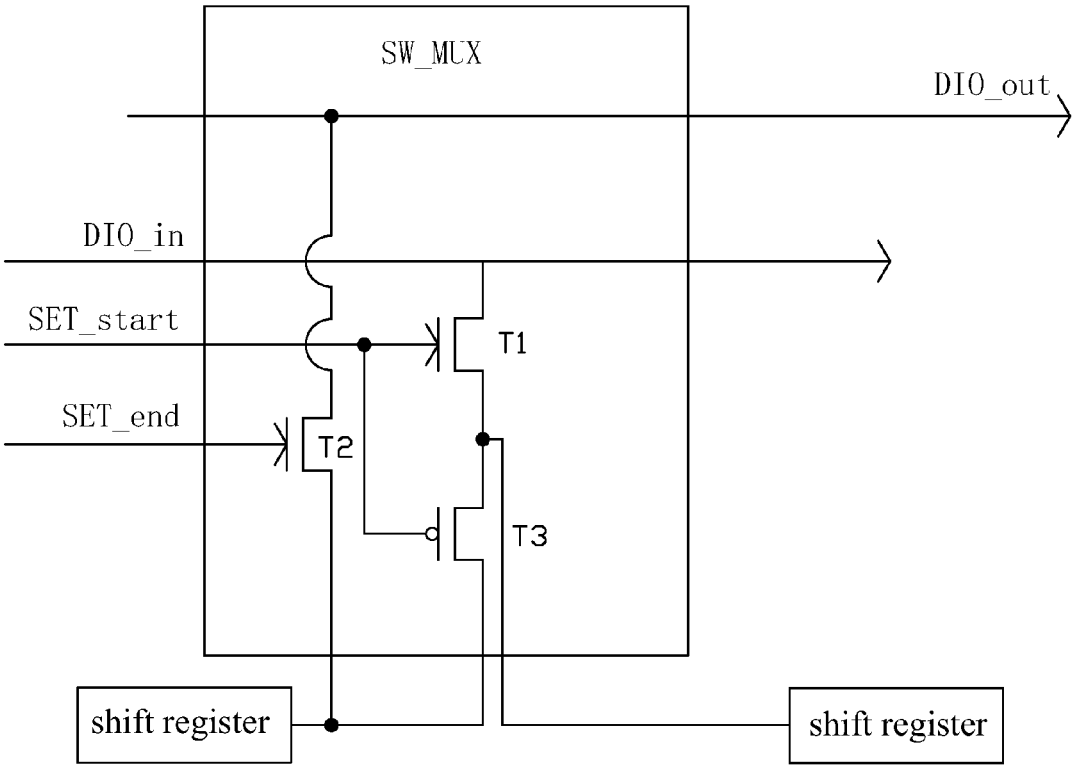
FIG. 4 is a circuit diagram of the combination switch in the source driver of the liquid crystal panel of unequal row drive width according to the present invention.

Please refer to FIG. 4. The input signal decoding control unit 10 comprises a combination switch SW_MUX, and the combination switch SW_MUX comprises first thin film transistor T1, a second thin film transistor T2 and a third reverse thin film transistor T3. A gate of the first thin film transistor T1 is electrically coupled to the data signal output channel start address signal SET_start, and a source is electrically coupled to the data signal input sequence control signal DIO_in, and a drain is electrically coupled to a register of the data signal output channel corresponding to a start address and a source of the third reverse thin film transistor T3; a gate of the second thin film transistor T2 is electrically coupled to the data signal output channel end address signal SET_end, and a source is electrically coupled to the data signal output sequence control signal DIO_out, and a drain is electrically coupled to a register of the data signal output channel corresponding to an end address and a drain of the third reverse thin film transistor T3; a gate of the third reverse thin film transistor T3 is electrically coupled to the data signal output channel start address signal SET_start, and the source is electrically coupled to the drain of the first thin film transistor T1, and the drain is electrically coupled to the drain of a second thin film transistor T2.

Figure 6:
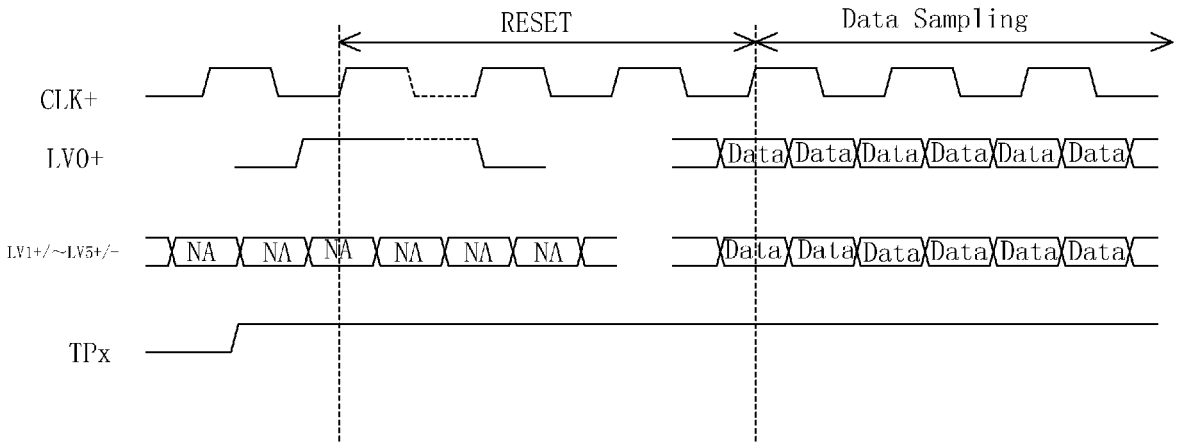
FIG. 6 is a waveform diagram of a mini-LVDS transport protocol according to prior art.
Figure 7:
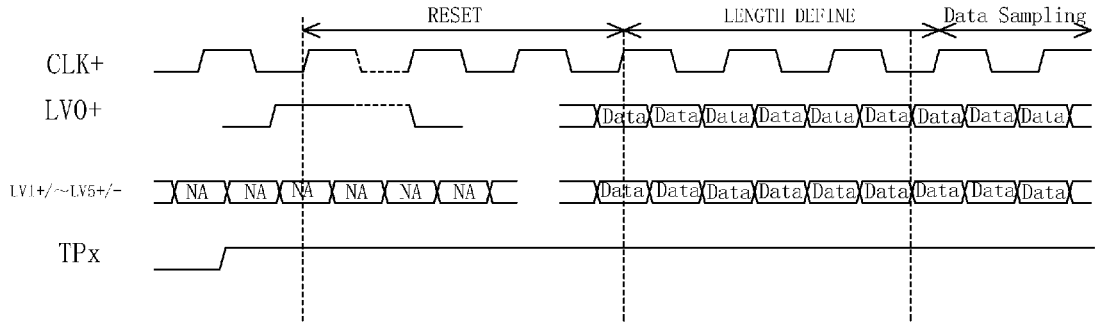
FIG. 7 is a waveform diagram of a mini-LVDS transport protocol after improvement according to the present invention.

Furthermore, the data signal output channel start address signal SET_start and the data signal output channel end address signal SET_end are encoded in transport packages of data signal Data and transported with the data signal Data together. Preferably, the data signal output channel start address signal SET_start, the data signal output channel end address signal SET_end and the data signal are transported by improving the mini-LVDS transport protocol. Please refer to FIG. 6. Generally, the mini-LVDS transport modes can be categorized into two kinds of RESET and DataSampling. Please refer to FIG. 7. The present invention improves the mini-LVDS transport modes in general definition. A length setting mode LENGTH DEFINE is added by amending decoding topology (protocol) of the mini-LVDS transport protocol, and the length setting mode LENGTH DEFINE is employed for transporting the data signal output channel start address signal SET_start and the data signal output channel end address signal SET_end.

A decoder is employed to decode the data signal output channel start address signal SET_start and the data signal output channel end address signal SET_end which are encoded in the transport packages of the data signal Data to acquire a data signal output channel start address and a data signal output channel end address.

Figure 5:
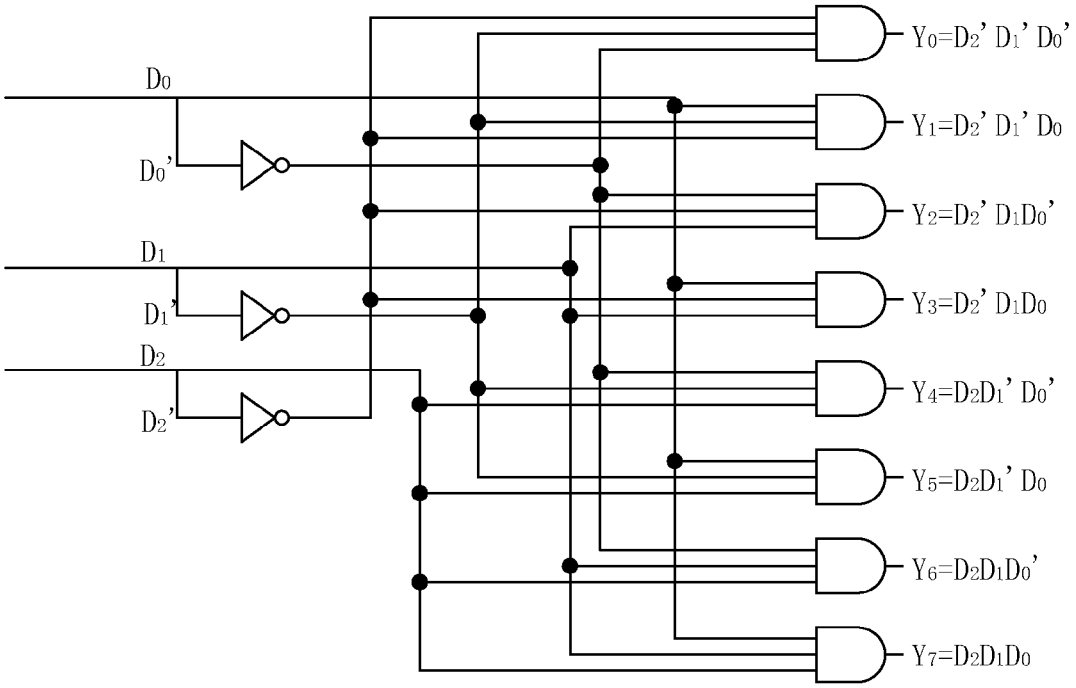
FIG. 5 is a circuit diagram of a kind of decoder in the source driver of the liquid crystal panel of unequal row drive width according to the present invention.

Specifically, please refer to FIG. 5. FIG. 5 is a circuit diagram of a 3-to-8 line decoder according to the present invention. The input end of the decoder comprises a first, a second and a third input channels, and each channel are divided into a forward channel and a reverse channel, which include a first, a second and a third forward input channels D0, D1, D2 and a first, a second and a third reverse input channels D0', D1', D2'. As transporting the digital signal "0" and "1" through the forward input channel, the signals are unchanged; as transporting through the reverse input channel, "0" will be reversed to be "1", and "1" will be reversed to be "0". The output end of the decoder comprises a first to an eighth output channels Y0 to Y7, and Each output channel receives input signals from three of the sixth channels, the first, the second, the third forward input channels D0, D1, D2 and the first, the second, the third reverse input channels D0', D1', D2'. The combination of the three channels of receiving the input signals for each output channel is different from the others. The first output channel Y0 is illustrated. The first output channel Y0 receives signals transported from the first, the second, the third reverse input channels D0', D1', D2', i.e. Y0=D0', D1', D2'; as all the signals transported from the first, the second, the third reverse input channels D0', D1', D2' are "1", i.e. all the signals inputted into the first, the second, the third input channels are "0", which "3' b000" signal is inputted into the decoder, Y0=1, and the first output channel Y0 is activated to control the data signal output channel of corresponding address to be opened. Similarly, the relationships between all the input signals of the decoder and activated output channels are listed in the following table 1. The input signals of the decoder are the data signal output channel start address signal SET_start and the data signal output channel end address signal SET_end.

TABLE 1

| D2D1D0 | Y0 | Y1 | Y2 | Y3 | Y4 | Y5 | Y6 | Y7 |
|---|---|---|---|---|---|---|---|---|
| 3'b000 | 1 | | | | | | | |
| 3'b001 | | 1 | | | | | | |
| 3'b010 | | | 1 | | | | | |
| 3'b011 | | | | 1 | | | | |
| 3'b100 | | | | | 1 | | | |
| 3'b101 | | | | | | 1 | | |
| 3'b110 | | | | | | | 1 | |
| 3'b111 | | | | | | | | 1 |

On a basis of the source driver of the liquid crystal panel of unequal row drive width, the present invention further provides a source drive method of a liquid crystal panel of unequal row drive width, comprising steps of:

step 1, referring to FIG. 3, FIG. 4, together, providing a source driver of the liquid crystal panel of unequal row drive width;

The source driver of a liquid crystal panel of unequal row drive width, comprising an input signal decoding control unit 10 and a plurality of data signal output channels 20 electrically coupled to the input signal decoding control unit 10.

The data signal output channels 20 comprise: a shift register and a main latch circuit electrically coupled to the input signal decoding control unit 10, a sub latch circuit, a voltage potential conversion circuit electrically coupled to the sub latch circuit, a digital to analog converter electrically coupled to the voltage potential conversion circuit, an output buffer circuit electrically coupled to the digital to analog converter and an output circuit electrically coupled to the output buffer circuit.

The input signal decoding control unit 10 comprises a combination switch SW_MUX, and the combination switch SW_MUX comprises a first thin film transistor T1, a second thin film transistor T2 and a third reverse thin film transistor T3. A gate of the first thin film transistor T1 is electrically coupled to the data signal output channel start address signal SET_start, and a source is electrically coupled to the data signal input sequence control signal DIO_in, and a drain is electrically coupled to a register of the data signal output channel corresponding to a start address and a source of the third reverse thin film transistor T3; a gate of the second thin film transistor T2 is electrically coupled to the data signal output channel end address signal SET_end, and a source is electrically coupled to the data signal output sequence control signal DIO_out, and a drain is electrically coupled to a register of the data signal output channel corresponding to an end address and a drain of the third reverse thin film transistor T3; a gate of the third reverse thin film transistor T3 is electrically coupled to the data signal output channel start address signal SET_start, and the source is electrically coupled to the drain of the first thin film transistor T1, and the drain is electrically coupled to the drain of a second thin film transistor T2.

step 2, inputting a data signal output channel start address signal SET_start, a data signal output channel end address signal SET_end and a data signal input sequence control signal DIO_in to the input signal decoding control unit 10.

In the step 2, the data signal output channel start address signal SET_start and the data signal output channel end address signal SET_end are encoded in transport packages of data signal Data and transported with the data signal Data together. Preferably, A length setting mode LENGTH DEFINE is added by amending decoding topology of the mini-LVDS transport protocol, and the length setting mode LENGTH DEFINE is employed for transporting the data signal output channel start address signal SET_start and the data signal output channel end address signal SET_end.

step 3, decoding the received data signal output channel start address signal SET_start and the received data signal output channel end address signal SET_end and setting a data signal output channel start address and a data signal output channel end address by the input signal decoding control unit 10.

Specifically, a 3-to-8 line decoder as shown in FIG. 5 is employed to decode the data signal output channel start address signal SET_start and the data signal output channel end address signal SET_end which are encoded in the transport packages of the data signal Data to acquire a data signal output channel start address and a data signal output channel end address.

step 4, inputting the data signal Data corresponding to the data signal channels 20 between the data signal output channel start address and the data signal output channel end address, and transporting the data signal Data to the corresponding pixels.

Figure 8:
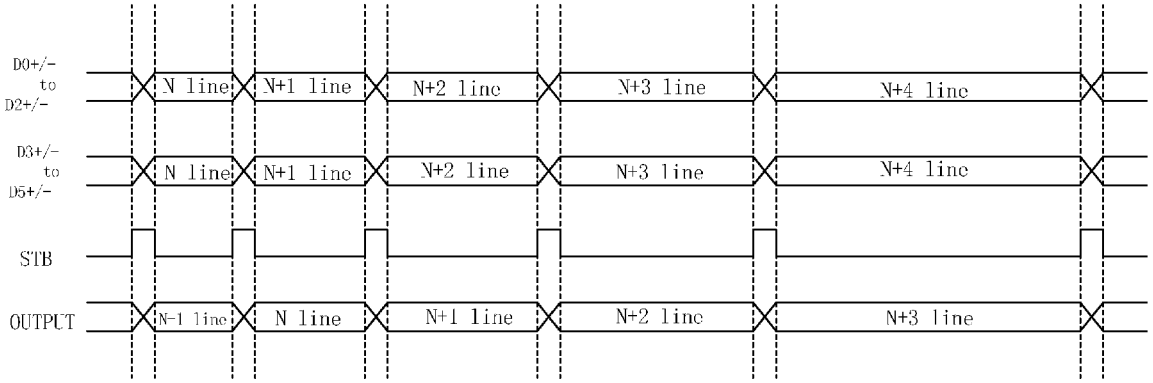
FIG. 8 is an output waveform diagram of transmission according to the mini-LVDS transport protocol shown in FIG. 7.
Figure 9:
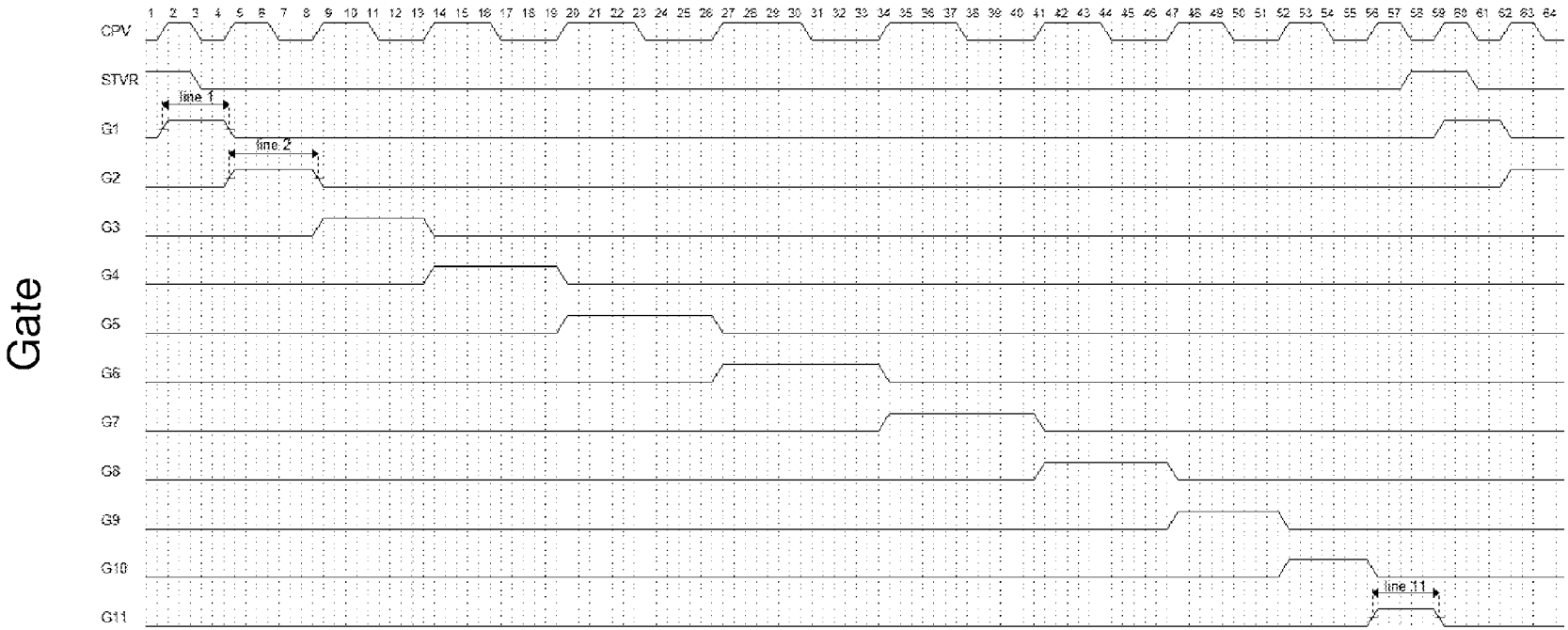
FIG. 9 is a row drive width waveform diagram of the source driver of the liquid crystal panel of unequal row drive width according to the present invention.

Please refer to FIG. 8 and FIG. 9. FIG. 8 is an output waveform diagram of transmission according to the improved mini-LVDS transport protocol of the present invention. FIG. 9 is a row drive width waveform diagram of the source driver according to the present invention. As shown in FIG. 8, FIG. 9, the outputted row drive width of the present invention changes as the data signal output channel start address and the data signal output channel end address change. The dynamical adjustment to the row drive width of scan for each row can be realized.

In conclusion, in the source drive method of the liquid crystal panel of unequal row drive width according to the present invention, by providing the input signal decoding control unit electrically coupled to the plurality of data signal output channels and encoding the data signal output channel start address signal and the data signal output channel end address signal in the transport packages of the data signal to be transported to the input signal decoding control unit, the input signal decoding control unit controls the amount of activated data signal output channels to adjust the row drive width for each scan according to the received data signal output channel start address signal and the received data signal output channel end address signal. The row drive width of scan for each row can be dynamically adjusted to transport the data signal to the pixels required to display in each row and not to transport the data signal to the pixels which are not required to display in each row. It is applicable for non rectangular display for reducing the output power of the liquid crystal panel and the source driver of the liquid crystal panel of unequal row drive width is derived from the present drive structure design. The structure is simple.

Above are only specific embodiments of the present invention, the scope of the present invention is not limited to this, and to any persons who are skilled in the art, change or replacement which is easily derived should be covered by the protected scope of the invention. Thus, the protected scope of the invention should go by the subject claims.

What is claimed is:

1. A source driver of a liquid crystal panel of unequal row drive width, comprising an input signal decoding control unit and a plurality of data signal output channels electrically coupled to the input signal decoding control unit;

the input signal decoding control unit receives a data signal output channel start address signal, a data signal output channel end address signal and a data signal input sequence control signal;

the input signal decoding control unit outputs a data signal output sequence control signal;

the input signal decoding control unit controls an amount of activated data signal output channels to adjust a row drive width for each scan according to the received data signal output channel start address signal and the received data signal output channel end address signal;

wherein the input signal decoding control unit comprises a combination switch, and the combination switch comprises a first thin film transistor, a second thin film transistor and a third reverse thin film transistor;

a gate of the first thin film transistor is electrically coupled to the data signal output channel start address signal, and a source is electrically coupled to the data signal input sequence control signal, and a drain is electrically coupled to a register of the data signal output channel corresponding to a start address and a source of the third reverse thin film transistor;

a gate of the second thin film transistor is electrically coupled to the data signal output channel end address signal, and a source is electrically coupled to the data signal output sequence control signal, and a drain is electrically coupled to a register of the data signal output channel corresponding to an end address and a drain of the third reverse thin film transistor;

a gate of the third reverse thin film transistor is electrically coupled to the data signal output channel start address signal, and the source is electrically coupled to the drain of the first thin film transistor, and the drain is electrically coupled to the drain of a second thin film transistor.

2. The source driver of the liquid crystal panel of unequal row drive width according to claim 1, wherein the data signal output channel start address signal and the data signal output channel end address signal are encoded in transport packages of data signal and transported with the data signal together.

3. The source driver of the liquid crystal panel of unequal row drive width according to claim 2, wherein a length setting mode is added by amending decoding topology of a mini-LVDS transport protocol, and the length setting mode is employed for transporting the data signal output channel start address signal and the data signal output channel end address signal.

4. The source driver of the liquid crystal panel of unequal row drive width according to claim 2, wherein a 3-to-8 line decoder is employed to decode the data signal output channel start address signal and the data signal output channel end address signal which are encoded in the transport packages of the data signal.

5. The source driver of the liquid crystal panel of unequal row drive width according to claim 1, wherein the data signal output channels comprise: a shift register and a main latch circuit electrically coupled to the input signal decoding control unit, a sub latch circuit, a voltage potential conversion circuit electrically coupled to the sub latch circuit, a digital to analog converter electrically coupled to the voltage potential conversion circuit, an output buffer circuit electrically coupled to the digital to analog converter and an output circuit electrically coupled to the output buffer circuit.

6. A source driver of a liquid crystal panel of unequal row drive width, comprising an input signal decoding control unit and a plurality of data signal output channels electrically coupled to the input signal decoding control unit;

the input signal decoding control unit receives a data signal output channel start address signal, a data signal output channel end address signal and a data signal input sequence control signal;

the input signal decoding control unit outputs a data signal output sequence control signal;

the input signal decoding control unit controls an amount of activated data signal output channels to adjust a row drive width for each scan according to the received data signal output channel start address signal and the received data signal output channel end address signal;

wherein the input signal decoding control unit comprises a combination switch, and the combination switch comprises a first thin film transistor, a second thin film transistor and a third reverse thin film transistor;

a gate of the first thin film transistor is electrically coupled to the data signal output channel start address signal, and a source is electrically coupled to the data signal input sequence control signal, and a drain is electrically coupled to a register of the data signal output channel corresponding to a start address and a source of the third reverse thin film transistor;

a gate of the second thin film transistor is electrically coupled to the data signal output channel end address signal, and a source is electrically coupled to the data signal output sequence control signal, and a drain is electrically coupled to a register of the data signal output channel corresponding to an end address and a drain of the third reverse thin film transistor;

a gate of the third reverse thin film transistor is electrically coupled to the data signal output channel start address signal, and the source is electrically coupled to the drain of the first thin film transistor, and the drain is electrically coupled to the drain of a second thin film transistor;

wherein the data signal output channels comprise: a shift register and a main latch circuit electrically coupled to the input signal decoding control unit, a sub latch circuit, a voltage potential conversion circuit electrically coupled to the sub latch circuit, a digital to analog converter electrically coupled to the voltage potential conversion circuit, an output buffer circuit electrically coupled to the digital to analog converter and an output circuit electrically coupled to the output buffer circuit.

7. The source driver of the liquid crystal panel of unequal row drive width according to claim 6, wherein the data signal output channel start address signal and the data signal output channel end address signal are encoded in transport packages of data signal and transported with the data signal together.

8. The source driver of the liquid crystal panel of unequal row drive width according to claim 7, wherein a length setting mode is added by amending decoding topology of a mini-LVDS transport protocol, and the length setting mode is employed for transporting the data signal output channel start address signal and the data signal output channel end address signal.

9. The source driver of the liquid crystal panel of unequal row drive width according to claim 7, wherein a 3-to-8 line decoder is employed to decode the data signal output channel start address signal and the data signal output channel end address signal which are encoded in the transport packages of the data signal.

10. A source drive method of a liquid crystal panel of unequal row drive width, comprising steps of:

step 1, providing a source driver of the liquid crystal panel of unequal row drive width;

the source driver of a liquid crystal panel of unequal row drive width, comprising an input signal decoding control unit and a plurality of data signal output channels electrically coupled to the input signal decoding control unit;

step 2, inputting a data signal output channel start address signal, a data signal output channel end address signal and a data signal input sequence control signal to the input signal decoding control unit;

step 3, decoding the received data signal output channel start address signal and the received data signal output channel end address signal and setting a data signal output channel start address and a data signal output channel end address by the input signal decoding control unit;

step 4, inputting the data signal corresponding to the data signal channels between the data signal output channel start address and the data signal output channel end address, and transporting the data signal to the corresponding pixels;

wherein in the step 2, the data signal output channel start address signal and the data signal output channel end address signal are encoded in transport packages of data signal and transported with the data signal together.

11. The source drive method of the liquid crystal panel of unequal row drive width according to claim 10, wherein the input signal decoding control unit comprises a combination switch, and the combination switch comprises a first thin film transistor, a second thin film transistor and a third reverse thin film transistor;

a gate of the first thin film transistor is electrically coupled to the data signal output channel start address signal, and a source is electrically coupled to the data signal input sequence control signal, and a drain is electrically coupled to a register of the data signal output channel corresponding to a start address and a source of the third reverse thin film transistor;

a gate of the second thin film transistor is electrically coupled to the data signal output channel end address signal, and a source is electrically coupled to the data signal output sequence control signal, and a drain is electrically coupled to a register of the data signal output channel corresponding to an end address and a drain of the third reverse thin film transistor;

a gate of the third reverse thin film transistor is electrically coupled to the data signal output channel start address signal, and the source is electrically coupled to the drain of the first thin film transistor, and the drain is electrically coupled to the drain of a second thin film transistor.

12. The source drive method of the liquid crystal panel of unequal row drive width according to claim 10, wherein in the step 2, a length setting mode is added by amending decoding topology of a mini-LVDS transport protocol, and the length setting mode is employed for transporting the data signal output channel start address signal and the data signal output channel end address signal.

* * * * *